US005279741A

United States Patent [19]

Schott

[11] Patent Number: 5,279,741

[45] Date of Patent: Jan. 18, 1994

[54] PROCESS FOR REGENERATING USED FOUNDRY SAND

[75] Inventor: Klaus Schott, Dinslaken, Fed. Rep. of Germany

[73] Assignee: Kuttner GmbH & Co. KG, Fed. Rep. of Germany

[21] Appl. No.: 967,526

[22] Filed: Oct. 27, 1992

Related U.S. Application Data

[63] Continuation of Ser. No. 828,522, Jan. 10, 1992, abandoned, which is a continuation in part of PCT/DE91/00246, filed Mar. 20, 1991.

[30] Foreign Application Priority Data

Mar. 20, 1990 [DE] Fed. Rep. of Germany ..... 4008849

[51] Int. Cl.[5] ..... B01D 11/00; B22C 1/00

[52] U.S. Cl. ..... 210/634; 110/236; 164/5; 210/773; 241/17; 241/DIG. 10; 432/15; 432/58

[58] Field of Search ..... 210/634, 773, 739, 742, 210/770, 774, 804, 805, 806, 808, 743, 769; 241/17, 20-24, DIG. 10; 34/10; 110/236; 164/5; 432/15, 58

[56] References Cited

U.S. PATENT DOCUMENTS

| | | | |
|---|---|---|---|
| 4,008,856 | 2/1977 | Sears | 241/DIG. 10 |
| 4,508,277 | 4/1985 | Andrews | 164/5 |
| 4,636,168 | 1/1987 | Sandstrom et al. | 432/58 |
| 4,685,973 | 8/1987 | Ashton | 164/5 |
| 4,700,766 | 10/1987 | Godderidge | 164/5 |
| 4,960,162 | 10/1990 | Millager | 241/DIG. 10 |

FOREIGN PATENT DOCUMENTS

| | | | |
|---|---|---|---|
| 155392 | 6/1982 | Fed. Rep. of Germany | 34/10 |
| 1245395 | 7/1986 | U.S.S.R. | 164/5 |
| 1423875 | 9/1988 | U.S.S.R. | 34/10 |
| 2047588 | 12/1980 | United Kingdom | 164/5 |

*Primary Examiner*—Joseph W. Drodge

*Attorney, Agent, or Firm*—Wegner, Cantor, Mueller & Player

[57] ABSTRACT

The invention relates to a process for regenerating used foundry sand, whose original molding sand contained, as the molding material, inorganic binders such as, for example and especially, bentonite ("inorganic used sand") and/or organic binders such as, for example and especially, phenolic resins and/or furan resins ("organic used sand"), wherein the used sand to be reconditioned is impregnated with water and then transferred in the moist state into a heated fluidized bed.

26 Claims, 1 Drawing Sheet

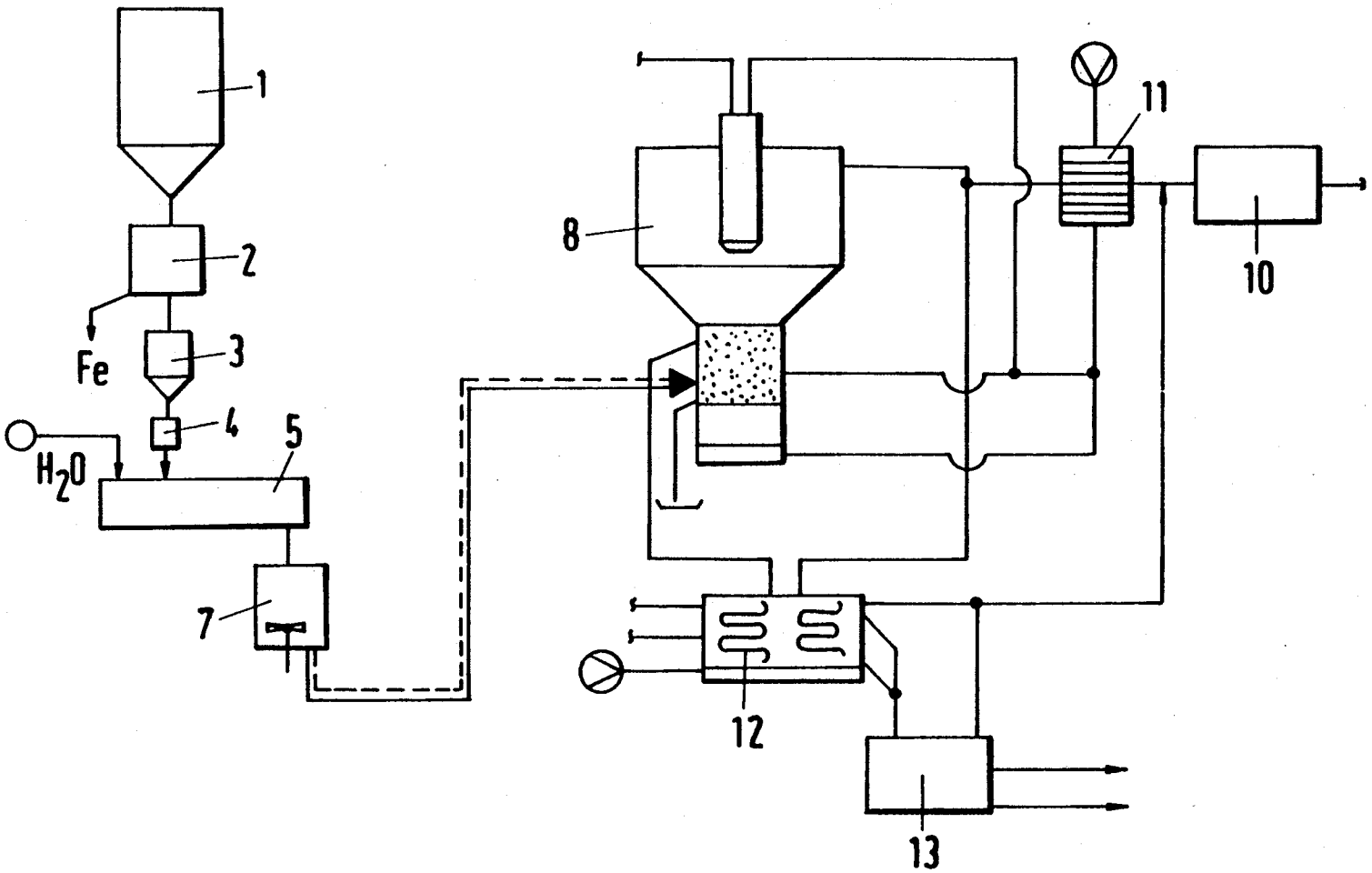
1
2
Fe
3
4
5
$H_2O$
7
8
10
11
12
13

PROCESS FOR REGENERATING USED FOUNDRY SAND

This application is a continuation of U.S. application Ser. No. 07/828,522 filed Jan. 10, 1992, now abandoned, which is a continuation-in-part of PCT/DE91/00246 filed Mar. 20, 1991.

The invention relates to a process for regenerating used foundry sand, where the original molding sand contains, as the molding material, inorganic binders such as, for example and especially, bentonite (herein referref to as "inorganic used sand") and/or organic binders such as, for example and especially, phenolic resins and/or furan resins (herein referref to as "organic used sand").

In the case of inorganically bound molding sands, the binder, bentonite or the like—depending on the degree of the action of heat during the casting step—is in each case fixed in the form of a shell on the surface of the sand bodies by dead-burning (oolithization), whereas, in the case of molding sands with organic binders, the thermal decomposition thereof takes place in the course of the casting step and hence firmly adhering residues of carbon-rich degradation products of the organic binders are formed on the surface of the sand grains. Furthermore, as a result of further additives, contaminations of the used sand occur such as, for example, the formation of vitreous carbon from additives.

Whereas used (foundry) sand has in the past at least predominantly been dumped in landfills, it is nowadays necessary, because of an acute shortage of available landfill space and not least also for cost reasons, to regenerate used sand, i.e. to recondition it, so that it is re-usable. However, this presupposes (at least for unrestricted use) that the abovementioned binder shells and other impurities of the used sand can be separated from the quartz grains of the sand and segregated.

For a regeneration of used sand, which at least very predominantly consists of organic used sand, it is known to treat it thermally by heating at a temperature of about 800° C. and/or, if necessary, to treat it pneumatically. The binder shells and other impurities of the used sand are thus removed as a rule to such an extent that the used sand can be re-used as molding sand. On the other hand, this thermal reconditioning process does not lead to a satisfactory result in the case of inorganic used sands.

The thermal-mechanical process known from German Patent Specification 3,103,030 leads at best to useful results when the proportion of inorganic used sand is relatively small. This process thus does not solve the above problems, since the used sand arising is as a rule inorganic used sand to the extent of more than two thirds.

Taking into account this situation, it was proposed in German Patent Specification 3,815,877 to subject the regenerated produce (pre-)treated thermally-mechanically (for example according to German Patent Specification 3,103,030) subsequently to an ultrasonic treatment in water (as a coupling layer). In this way, the binder shells sintered onto the sand grains are to be caused to flake off and the degree of oolitization is to be reduced to normal values, and at the same time the basic pH value of the regenerated product is to be adjusted to an almost neutral value.

Quite apart from the large and expensive equipment for carrying out the abovementioned process and from the high operating costs for this process, further costs arise as a result of the fact that the reconditioned used sand must afterwards still be dried, so that this multistage process is no longer economical, and it must moreover also be stated that, due to a relatively high wear of the sand grains, only a relatively low yield of regenerated product of adequate quality is achievable.

For regenerating inorganic used sand, processes have been developed, in which it was attempted to remove the binder shells by wet means from the surface of the sand grains, namely by carrying out a mechanical stirring step in an aqueous sand suspension, leading to intensive mutual friction of the sand grains, this process step, also described as attrition,, being as a rule repeated several times and, if appropriate, being influenced and/or intensified by setting particular sand/water mixing ratios (see, for example, U.S. Pat. No. 2,783,511 or German Offenlegungsschrift 3,019,096).

A disadvantage of this wet process is, inter alia, the circumstance that hydrocarbon compounds of organic used sand constituents as well as vitreous carbon and its precursors cannot be removed to a sufficient extent. These substances act (like, for example, also clay-type constituents) similar to lubricants and impede the desired attrition, so that an adequate satisfactory regeneration result is not obtainable even with multistage attrition.

To provide a remedy in this respect, it was suggested in Austrian Patent Specification 387,921 to arrange desludging (by means of a classifier) downstream of each attrition stage, in order to remove the "lubricants" from the circulating water in this way and thus to intensify the desired attrition. However, even if a result satisfactory in technical respects were achievable with three-fold, four-fold or multiple attrition, this process evidently suffers very considerably from economic aspects due to the inherent costs. A further point is that, in this process, a firmly adhering structure of finely dispersed, porous silica, which entails an increased binder requirement for new (foundry) sand, if the reconditioned old sand is re-used, remains on the grain surface.

It is the object of the present invention, while avoiding the abovementioned and further disadvantages, to provide a process which is satisfactory in both technical and economic respects for reconditioning used (foundry) sand in which a regenerated product which can be used almost universally and has relatively small amounts of harmful constituents is achievable with (as compared with the state of the art) relatively low costs in terms of engineering and economics, which process allow a re-use without problems in place of new sand for producing molds and cores in foundries.

According to the invention, this object is achieved by impregnating the used sand to be reconditioned (initially) with water and then transferring it in the moist state into a heated fluidized bed the water present in the pores being vaporized spontaneously by the resulting shock heating of the used sand to be reconditioned and the shells of (at least) the (inorganic) binder being substantially cracked off because of the resulting considerable increase in volume or being at least loosened to such an extent that they can be directly separated in the fluidized bed from the quartz grains. The hitherto conventional drying of wet-regenerated used sand by means of hot air of about 150°-300° C. in various types of equipment does not achieve such a cracking or loosening effect, as the abovementioned binder requirement proves.

In addition, the heat removal by the vaporization of water in the immediate vicinity of the quartz grain prevents the change in crystal modification, which is possible due to the shock-like heating of the quartz grains, and also the disintegration of grains. Moreover, the sintering of mullite, which has been formed by the action of heat from bentonite, onto the quartz grains is prevented or at least inhibited.

In the process according to the invention, it is also not necessary that the used sand, which can consist of any desired mixtures of organically and inorganically bound used sand, must during its wetting or its impregnation pass through an attrition stage otherwise necessary for wet regeneration. Owing to the simplified working procedure and the less expensive equipment provision, this results in considerable economic advantages.

In the process according to the invention, it is thus not at all necessary (even though this may be expedient at least in certain cases) to ensure a fundamental separation of organic and inorganic used sands, as it were before the reconditioning, but it is as a rule expedient to recondition the organic and/or inorganic used sands essentially separately from one another, if they arise separately anyway, as is frequently the case.

It is also advantageous in the process according to the invention that virtually no pollutant-carrying residual quantities arise at all, that, according to the statement above, it is, inter alia, also not necessary to adhere to a defined quantitative ratio of different used sands and that, as is evident, no separate process branches whatsoever have to be provided and mutually matched, which, as is known, can as a rule cause quite considerable difficulties especially in a process run at elevated temperature.

As a rule, it has proved to be extremely advantageous, if the used sand to be reconditioned is impregnated with water to such an extent, agents for reducing the surface tension being added to the water if required, that the pores located in the grain shells are at least substantially filled with water, in order to optimize the effect already indicated above and hence ultimately the complete used sand reconditioning and the quality of the regenerated product.

A special embodiment of the invention provides for carrying out the impregnation of the used sand with circulated water, in order thus to dissolve out harmful elements, especially alkalis. This procedure is expedient whenever used sands, due to the use of alkali metal silicates or phenates as binder components, contain significant quantities of such ions. If these were left in the reconditioned sand, the resulting high basicity would severely restrict its re-usability.

The water used for impregnating the used sand is maintained at a pH of between 2 and 5 by, if appropriate continuous, addition of acid and circulated until a particular maximum salt concentration to be set has been reached. Its replacement by fresh water can here also take place continuously. Before the circulating water runs into the impregnation device, it passes each time through a settling tank and, if appropriate, also a filter, whereby the solids taken up by the water from the sand are separated off as sludge and the latter can be recycled into the fluidized bed. The shock-type heating also of these solids thoroughly impregnated with water prevents sintering on the sand grains, and the organic constituents thereof burn out.

In a further development of this process variant, carbon dioxide is used instead of a mineral acid or carboxylic acid as the anionic component for the decomposition of the alkali metal silicates. A basic pH then establishes itself in the circulation water, but the alkalis are in the same way removed from the used sand, namely as carbonates. The alkaline solution still adhering to the sand is washed off from the grains by spraying on the dehydration screen with the fresh water required as make-up. The solution of soda or potash, obtained in this way, can be evaporated by waste heat and caused to crystallize, and the alkali can thus be recovered in utilizable form.

The process according to the invention is, however, highly satisfactory not only in technical but also in economic respects, especially since for example, the heated fluidized bed can in turn consist of sand (that is to say, in some cases even of already reconditioned used sand).

In order to have available a fluidized bed having a heat capacity which is sufficient for the desired effect, the ratio of the rate of moist used sand fed per minute to the rate of sand in the fluidized bed can be selected within the range from about 50 to 100.

According to the invention, the fluidized bed is most preferably heated from above, and in particular preferably by high-velocity burners, gaseous fuels having proved to be particularly advantageous as the addition fuel (beyond the fuel constituents already contained in the used sand).

To achieve the effects already discussed above, the fluidized bed can preferably be maintained at a steady temperature of about 750° to 950° C.

According to further preferred embodiments of the present invention, the temperature in the solids on the one hand and in the gas space above the fluidized bed on the other hand can be adjusted to different levels, and the residence time of the used sand to be reconditioned in the fluidized bed can also be adjusted, namely as a function of its type.

In this way, complete burn-out of organic substances is effected also in the fly dust and hence the decontamination thereof.

To intensify and/or to accelerate the wetting of the used sand to be reconditioned, it can be advantageous if the used sand to be wetted and reconditioned is thoroughly wetted in a vacuum.

As a rule, it is also most advantageous if the fluidizing velocity of the fluidized bed is adjustable within wide limits, in order to be able to adapt the operating conditions in the best possible way to the particular requirements of the used sand to be recondition. Furthermore, it can also be advantageous to precipitate sand in a separator or the like downstream of the fluidized bed and it can then also be advantageous to recycle this precipitated sand partially into the fluidized bed.

The used sand reconditioned to this extent (regenerated product) can expediently be subjected to a mechanical final purification.

The invention is explained in more detail below in an illustrative example with reference to a drawing.

In a diagrammatic illustration, the drawing shows a bunker 1, in which the used sand which as a rule is a mixture of inorganic and organic used sand, is collected. The used sand to be reconditioned is fed from the bunker 1 to a used sand preparation 2, consisting of, for example, the magnetic separation of Fe parts, the lump comminutor and screening, and passes into a holding bunker 3.

From the holding vessel, the prepared used sand is fed by means of a flow control device 4 to a mixer 5, to which water 6 and surface tension-reducing agents are also added under flow control. The water is heated to a maximum of 95° C. by means of waste heat.

The wet sand is agitated in a conditioner 7 until complete thorough wetting of the pores of the grain shells has been achieved, and then passes under flow control into the fluidized-bed furnace 8.

Due to the extremely rapid heat transfer (and the good mixing of the fluidized bed), the wet used sand to be reconditioned is abruptly heated to an operating temperature of from 800° to 950°, the formation of steam, already described above, cracking the fireclay shells off from the (quartz) sand grains or at least very considerably loosening them, and organic pollutants being completely burned.

The furnace exit gas is cooled in a heat exchanger 11 with preheating of the fluidizing air.

For cooling the furnace discharge, the latter passes first through a fluidized bed cooler 12, in which the water required for the impregnation is preheated to 70° to 95° C. and the sensible heat of the sand is recovered in the form of steam or hot water.

A final treatment of the regenerated product obtained takes place in a pneumatic purification device 13 and in a fractionation into (at least) two grain sizes ("coarse" and "fine"). The reconditioned used sand is universally re-usable, and the grain size of the new sand to be formed from the reconditioned used sand (if appropriate with a certain addition of new sand) can be determined by proportioning from the individual fractions, in order to obtain a used sand of predetermined mean grain size or a definite grain size range.

After cooling and pneumatic purification of the reconditioned sand, regenerated product and filter dust are obtained. The filter dust is free of pollutants and can be deposited in a landfill without reservations or be used, for example as a building material or aggregate.

I claim:

1. A process for reconditioning at least one of used organic or inorganic foundry sand formed from original molding sand which contained, as the molding material, inorganic binders in the case of inorganic used sand or organic binders in the case of organic used sand or mixtures thereof, which comprises impregnating the used sand to be reconditioned with water to such an extent as to substantially fill the pores between the grain shells of the sand with water and maintaining said impregnation of the sand until it enters a heated fluidized bed.

2. The process as claimed in claim 1, wherein the water used for impregnating the used sand is circulated and harmful alkali metal ions are dissolved out.

3. The process as claimed in claim 2, wherein said circulated water is maintained at a pH of between 2 and 5 by addition of mineral acids or carboxylic acids and is replaced by fresh water to such an extent that a salt concentration, which is to be pre-determined, in the circulated water is not exceeded.

4. The process as claimed in claim 2, wherein said circulated water is treated with $CO_2$ and alkali materials in the water are thus recovered as carbonates.

5. The process as claimed in claim 2, wherein said circulated water is purified and filtered and the sludge thus obtained is recycled into the fluidized bed.

6. The process of claim 1, wherein the heated fluidized bed consists of sand.

7. The process as claimed in claim 6, wherein the ratio of fluidized-bed sand to moist used sand entering the bed per minute is about 50 to 100.

8. The process as claimed in claim 1, wherein inorganic and organic used sands in any desired mixtures with one another are impregnated with water and these mixtures are then fed to the fluidized bed.

9. The process as claimed in claim 1, wherein used sand with at least predominantly organic binders is introduced separated into the fluidized bed from inorganic used sand being reconditioned.

10. The process as claimed in claim 9, wherein only the inorganic used sand is impregnated with water.

11. The process as claimed in claim 10, wherein surface tension-reducing agents are added to said water.

12. The process as claimed in claim 9, wherein exclusively organic used sand is separately introduced into the fluidized bed which has been impregnated separately with water.

13. The process as claimed in claim 12, wherein the water is preheated to 70° to 95° C.

14. The process as claimed in claim 9, wherein the inorganic used sand is subjected to a mechanical prepurification, whereby the fine material is separated off, and then is recycle untreated and mixed with other sand to be reconditioned.

15. The process as claimed in claim 1, wherein the fluidized bed is heated from above.

16. The process as claimed in claim 15, wherein said heating from above is achieved by using a gaseous fuel.

17. The process as claimed in claim 1, wherein the fluidized bed is maintained at a temperature between about 750° to 950° C.

18. The process as claimed in claim 1, wherein the temperatures in the fluidized bed on the one hand and in a gas space above the fluidized bed on the other hand are adjusted to different levels.

19. The process as claimed in claim 18, wherein fluidizing air for the bed is preheated by heat transfer from exhaust gas from the fluidized bed.

20. The process as claimed in claim 19, wherein the bed's temperature is controlled by maintaining a stoichiometric fuel/fluidizing air ratio.

21. The process as claimed in claim 1, wherein the residence time of the used sand to be reconditioned in the fluidized bed is adjustable.

22. The process as claimed in claim 1, wherein said impregnation is enhanced by means of a vacuum.

23. The process as claimed in claim 1, wherein the fluidizing velocity of the fluidized bed is adjustable within wide limits.

24. The process as claimed in claim 1, wherein sand, which has been precipitated in a separator or the like downstream of the fluidized bed, is partially recycled into the fluidized bed.

25. The process as claimed in claim 1, wherein the regenerated used sand is finally purified mechanically or pneumatically or mechanically/pneumatically.

26. The process as claimed in claim 1, wherein the exhaust gas from the fluidized bed has a temperature of about 450° to 750° C. and is quenched by means of water.

* * * * *